US007862373B2

(12) United States Patent
DeMay et al.

(10) Patent No.: US 7,862,373 B2
(45) Date of Patent: Jan. 4, 2011

(54) LOW PROFILE SEAL FOR FLOATING CONNECTOR INTERFACE

(75) Inventors: Bruce DeMay, Webster, NY (US); Joshua Gannon, Fairport, NY (US); Rollin Brown, Fairport, NY (US)

(73) Assignee: Harris Corporation, Melbourne, FL (US)

( * ) Notice: Subject to any disclaimer, the term of this patent is extended or adjusted under 35 U.S.C. 154(b) by 98 days.

(21) Appl. No.: 12/166,425

(22) Filed: Jul. 2, 2008

(65) Prior Publication Data

US 2010/0001513 A1 Jan. 7, 2010

(51) Int. Cl.
*H01R 13/40* (2006.01)

(52) U.S. Cl. ..... 439/587

(58) Field of Classification Search ..... 439/587–588, 439/248, 271, 607.01
See application file for complete search history.

(56) References Cited

U.S. PATENT DOCUMENTS 3,182,279 A * 5/1965 Fitz Gerald ..... 439/556
3,816,641 A 6/1974 Iversen
3,930,705 A 1/1976 Gallagher
3,941,444 A 3/1976 Bruni et al.
4,030,797 A * 6/1977 Nieman ..... 439/248
4,227,765 A * 10/1980 Neumann et al. ..... 439/248
5,011,426 A 4/1991 Colleran et al.
5,044,986 A * 9/1991 Baumanis ..... 439/548
5,112,241 A * 5/1992 Chesnut et al. ..... 439/273
5,458,507 A 10/1995 Colescott et al.
5,892,175 A 4/1999 Enos et al.
6,094,122 A 7/2000 Sexton
6,338,651 B1 1/2002 Svette, Jr. et al.

* cited by examiner

*Primary Examiner*—Jean F Duverne
(74) *Attorney, Agent, or Firm*—Harness, Dickey & Pierce, PLC

(57) ABSTRACT

An electrical connector has a flexible boot to create a flexible, sealed interface. A connector body has a plurality of pin receivers positioned within a tubular sleeve. The flexible boot is received in the connector body and includes a tubular body of elastically flexible material. The tubular body has a body diameter dimensionally controlled to provide an interference fit when received in the tubular sleeve. A boot flexible sleeve is positioned outward of the tubular body. A boot joining wall homogenously joins the tubular body to the flexible sleeve. A flange extends from a free end of the flexible sleeve defining a circular ring oriented transverse to and encircling the flexible sleeve. A boot ring fixes the flange to a panel. The connector body is thereafter elastically displaceable with respect to the panel when the tubular body deflects with respect to the flexible sleeve and the flange.

28 Claims, 11 Drawing Sheets

LOW PROFILE SEAL FOR FLOATING CONNECTOR INTERFACE

FIELD

The present disclosure relates to electrical connectors including battery connectors for communication equipment.

BACKGROUND

The statements in this section merely provide background information related to the present disclosure and may not constitute prior art.

Electrical connectors generally described further herein in reference to connectors for communication devices, including military field operative communication devices, are required to function in harsh environmental conditions. These conditions include extremes of temperature, humidity, and/or conditions of dust, dirt, and the like. The connectors must therefore provide an environmental seal as well as flexibility to allow for vibration and mechanical strain.

In order to provide for the above conditions, it is known to provide a large extrusion that can be fastened directly to the battery connector. After the connector is assembled by soldering, the extrusion is fastened with hardware to the connector assembly. Next, the first of two potting compounds is applied inside the extrusion cavity. This first potting compound is a non-hardening, silicone-based material that provides a flexible seal interface. The assembly is then fastened with hardware to the mechanical enclosure, which contains a physical feature (protrusion) that expends into the flexible potting compound to create the environmental seal. In order to prevent a pressure differential due to an immersion or altitude condition from causing the potting compound to creep and thus compromise the integrity of the seal, a mechanical plate is added to contain the compound. As there is an electrical interface passing through this plate, in the form of discrete wires for example, a hole exists in the plate that allows for the connections to pass through, which is also a path for the potting compound to displace. In order to prevent compound displacement, a second potting compound must be applied to the opening in the plate. This second compound is a silicone-based material that cures to a hardened state, thus preventing the initial compound from displacing out of the assembly.

SUMMARY

According to several embodiments of the present disclosure, a flexible boot for a sealed interface includes a tubular body of an elastically flexible material. A flexible sleeve positioned outward of the tubular body. A joining wall homogenously joining the tubular body to the flexible sleeve. A flange extending from a free end of the flexible sleeve defines a circular ring oriented substantially transverse to and encircling the flexible sleeve. The flange includes a flat engagement surface and an opposed surface having at least one raised seal ring extending therefrom.

In other embodiments, a flexible boot for a sealed electrical connector interface includes a tubular body of an elastically flexible material. A flexible sleeve positioned outward of the tubular body. A joining wall homogenously connects the flexible sleeve to the tubular body. A flange homogenously extending from a free end of the flexible sleeve defines a circular ring oriented substantially transverse to and encircling the flexible sleeve. A body flange extending transversely inward from a free end of the tubular body defining a diameter smaller than an inner diameter of the tubular body.

According to other embodiments, an electrical connector having a flexible boot operable to create a sealed interface includes a connector body having a plurality of pin receivers positioned within a tubular sleeve. A flexible boot is adapted to be received in the connector body. The flexible boot includes a tubular body of an elastically flexible material, the tubular body having a body diameter dimensionally controlled to provide an interference fit when received in the tubular sleeve of the connector body. A flexible sleeve is positioned outward of the tubular body. A joining wall homogenously joins the tubular body to the flexible sleeve. A flange extends from a free end of the flexible sleeve defining a circular ring oriented substantially transverse to and encircling the flexible sleeve.

According to further embodiments, an assembly for flexibly mounting an electrical connector includes a connector body having a tubular sleeve. The connector body is adapted to be slidably received in an aperture of a panel. A flexible boot is adapted to be received in the connector body. The flexible boot includes a tubular body of an elastically flexible material. The tubular body has a body diameter dimensionally controlled to provide an interference fit when received in the tubular sleeve of the connector body. A flexible sleeve is positioned outward of and homogenously connected to the tubular body. A flange defining a free end of the flexible sleeve is shaped as a circular ring oriented substantially transverse to and encircling the flexible sleeve. A boot ring is adapted to fix the flange with respect to the panel, the connector body thereafter elastically displaceable with respect to the panel when the tubular body deflects with respect to the flexible sleeve and the flange.

According to still other embodiments, a method for flexibly connecting and sealing an electrical connector to a panel includes extending a tubular sleeve from a connector body, coupling a flexible boot having a tubular body of elastically flexible material in the tubular sleeve, creating a boot flexible sleeve outward of the tubular body, homogenously joining the tubular body to the flexible sleeve using a boot joining wall, extending a flange from a free end of the flexible sleeve defining a circular ring oriented transverse to and encircling the flexible sleeve, and fixing the flange to the panel using a boot ring to permit the connector body to elastically displace with respect to the panel when the tubular body deflects with respect to the flexible sleeve and the flange.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
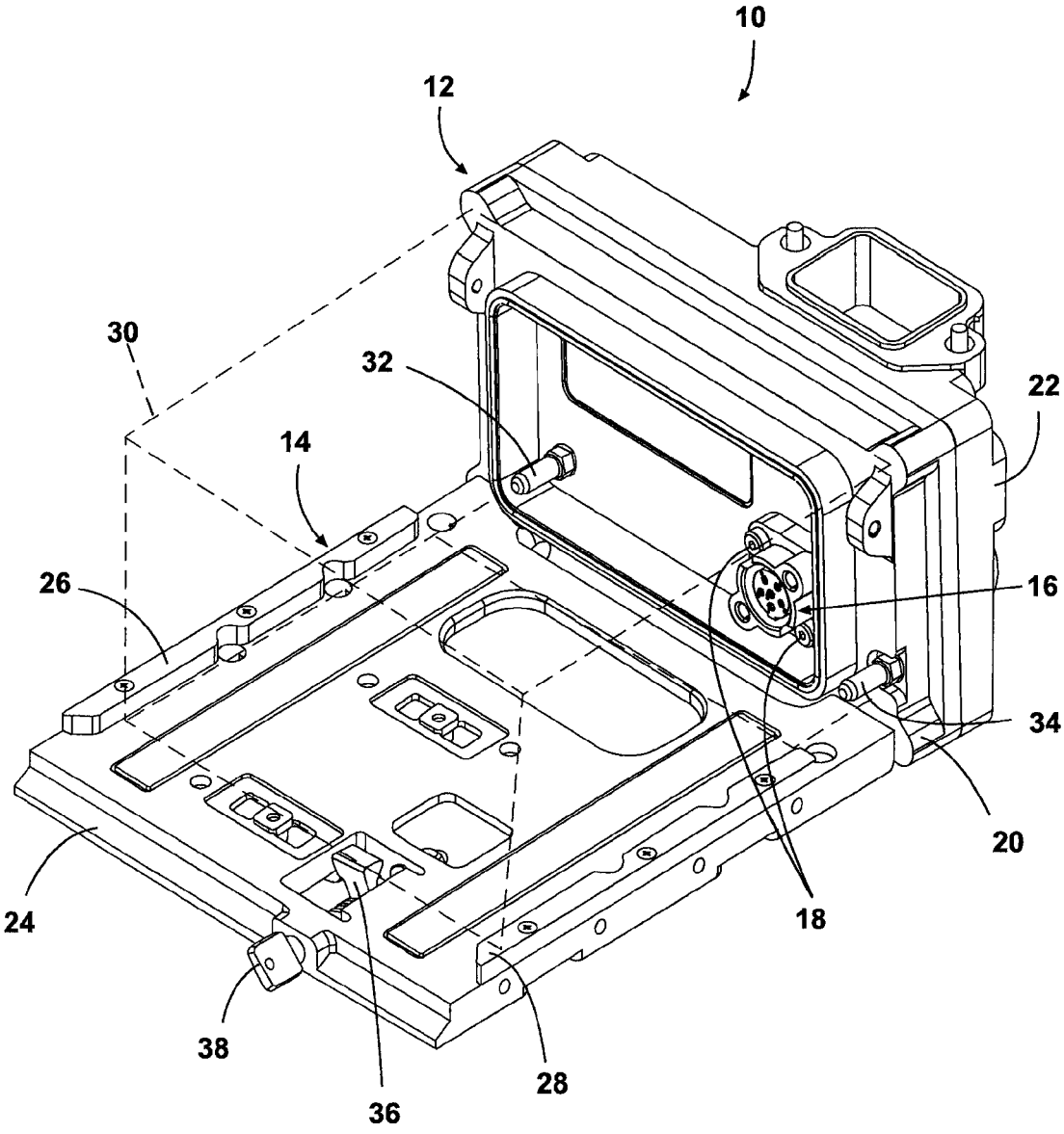
FIG. 1 is a front perspective view of a communications unit having a connector boot of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, a component mount assembly 10 includes an electrical panel assembly 12 connected to a component mount portion 14. Electrical panel assembly 12 includes an electrical connector 16 fastened using one or more shoulder fasteners 18 to a front panel 20. A rear panel 22 is also connected to front panel 20 on an opposite side of front panel 20 from connector 16.

Component mount portion 14 provides a mount plate 24 having first and second guides 26, 28 fastenably connected thereto which are positioned to support and orient a component 30 such as an RF communication device (shown in phantom). Component 30 includes a mating connector (not shown) having male extending pins adapted to be received by connector 16 when component 30 is slidably received by first and second guides 26, 28 and abutted against front panel 20. Abutting component 30 against front panel 20 also creates an environmental seal between the two. First and second alignment/shock pins 32, 34 can also extend from front panel 20 toward component 30 which can be provided to help align component 30 for electrical connection with connector 16. Shoulder fasteners 18 allow for a side-to-side sliding motion of connector 16 with respect to front panel 20 to assist with the alignment of component 30 with connector 16. After component 30 is landed on mount plate 24, a catch member 36 which is displaceable by rotation of a key 38 is engaged with component 30 to releasably latch component 30 into engagement with each of component mount portion 14 and electrical panel assembly 12.

Figure 2:
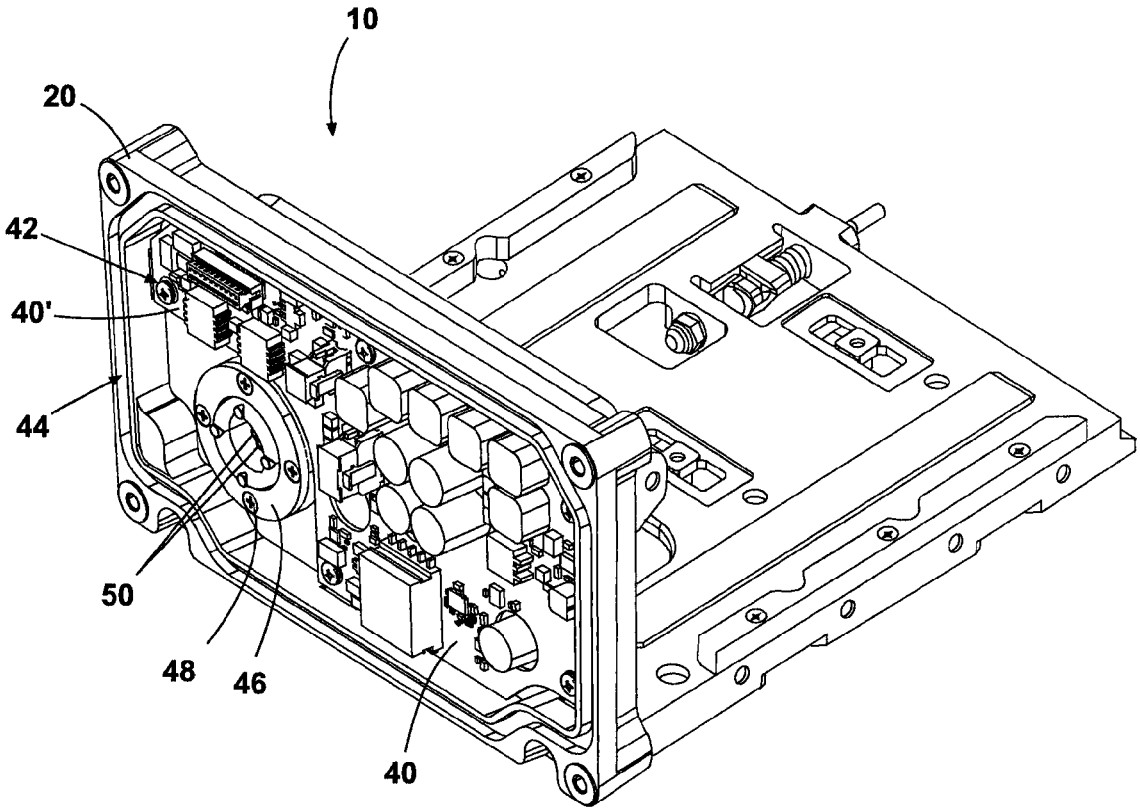
FIG. 2 is a rear perspective view of the communications unit of FIG. 1 modified to show an electronics enclosure visible with a cover portion removed.

Referring to FIG. 2 and again to FIG. 1, rear panel 22 has been removed for clarity. A circuit board 40 is releasably connected to an opposing side of front panel 20 using a plurality of fasteners 42, for example fastenably received through a portion 40' of circuit board 40. A peripheral slot 44 can also be created in front panel 20 which is adapted to receive a seal member (not shown) such as an O-ring or flexible seal installed to create an environmental seal between front and rear panels 20, 22 when rear panel 22 is installed. Circuit board 40 is shaped to provide clearance about a boot ring 46 which is fastenably connected to front panel 20 using a plurality of fasteners 48. Boot ring 46 and fasteners 48 define an additional portion of connector 16 together with a plurality of pin receivers 50 which can horizontally and vertically displace (as viewed in FIG. 2) with respect to boot ring 46.

Figure 3:
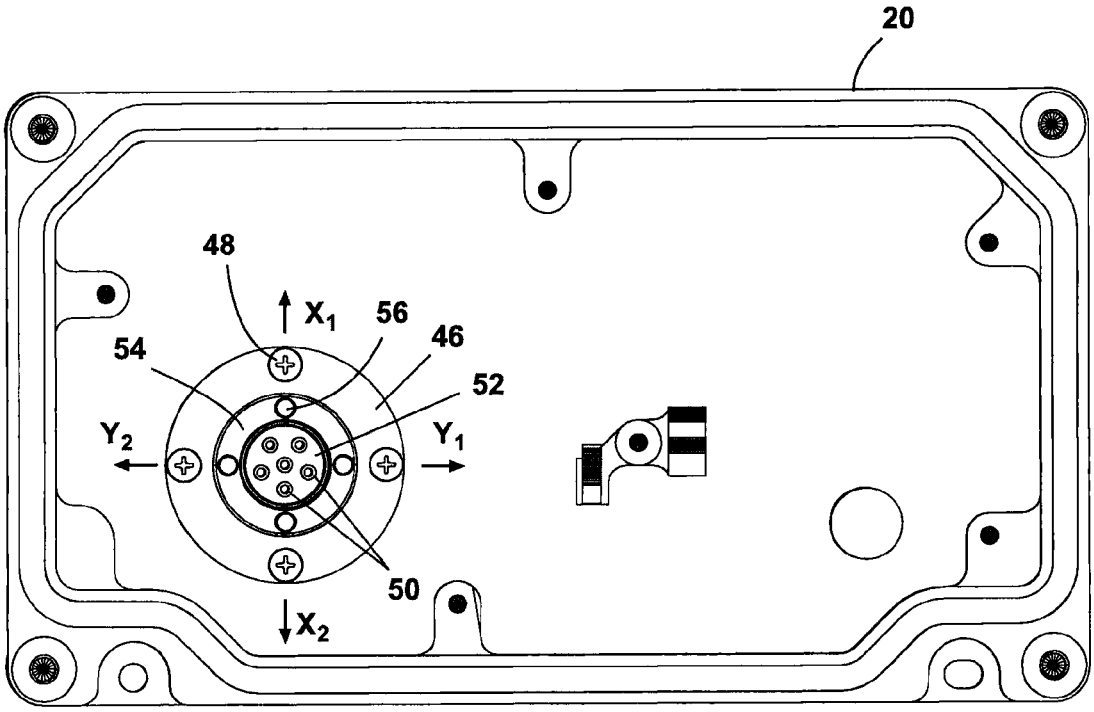
FIG. 3 is a rear elevational view of the electronics enclosure of FIG. 2 further showing an electronics component panel removed.

Referring to FIG. 3, pin receivers 50 define female members each provided with a pin receiving member 52. Pin receiving member 52 can be a polymeric material or can also be other material(s) which provide electrical insulation properties. Pin receiving member 52 is movable when received within a flexible connector boot 54. Flexible connector boot 54 can be made from a flexible, material such as rubber or a silicone rubber, or from a thermoplastic rubber such as Santoprene® available from ExxonMobil Chemical Company. According to several embodiments, the material of flexible boot connector 54 is a shore "A", durometer 50-60. When boot ring 46 is fastened using a plurality of fasteners 48, pin receiving member 52 is still free to deflect in any of the up or down $X_1$, $X_2$ or right to left $Y_1$, $Y_2$ directions due to the elastic flexibility of flexible connector boot 54. At least one, and in several embodiments a plurality of mold kickout members 56 are homogenously provided with flexible connector boot 54 which are used during a molding process creating flexible connector boot 54 to assist removal of flexible connector boot 54 from the mold. Mold kickout members 56 can face the viewer as viewed in FIG. 3.

Referring to FIGS. 4 and 5 and again to FIG. 3, boot ring 46 can be provided from a metal material or a rigid polymeric or composite material having a ring outer diameter "A" and a ring inner diameter "B". Ring outer diameter "A" can vary at the discretion of the manufacturer to suit the geometry of flexible connector boot 54. Ring inner diameter "B" is sized to slidably receive a portion of flexible connector boot 54. A ring-shaped body 58 of boot ring 46 includes a plurality of fastener clearance apertures 60 each having a countersink 62 created coaxially therewith. Body 58 has a ring thickness "C" which is predetermined based on the material of boot ring 46 to maintain an overall straightness/stiffness when boot ring 46 is clamped by fastening through apertures 60 to compress a portion of flexible connector boot 54.

Figure 6:
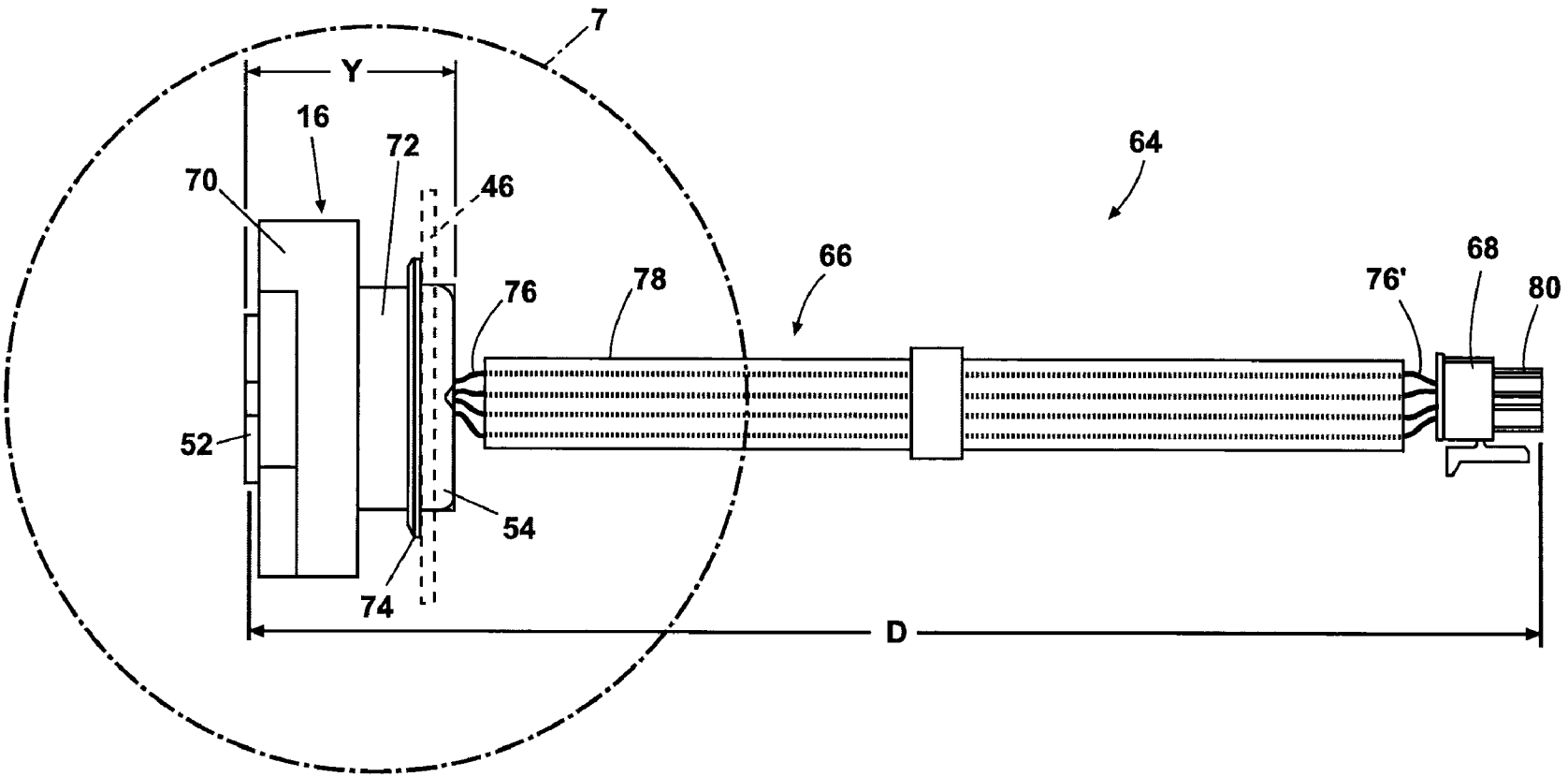
FIG. 6 is a top plan view of a power cable assembly having a flexible membrane of the present disclosure.

Referring to FIG. 6, a wiring assembly 64 can include connector 16 at a first end which is connected to a wiring harness 66 which is connected to a clip connector 68. Wiring assembly 64 can have an overall wiring assembly length "D" which can vary at the discretion of the manufacturer to suit the location of a power source or electrical component. Connector 16 includes a connector housing 70 having a homogenously extending connector sleeve 72 extending therefrom. Flexible connector boot 54 is partially received within connector sleeve 72 and also includes a flange 74 extending radially outward therefrom. Flange 74 is oriented to be contacted and partially compressed by boot ring 46 (shown in phantom for information) to fix a position of flange 74. A plurality of conductors such as conductors 76 are electrically connected to pin receiving member 52 and are collectively assembled for distribution within a protective sleeve 78. Opposite ends 76' of conductors 76 are individually connected using clip connector 68 to each of a plurality of contact members 80. A total assembled length "Y" of the assembly of connector 16 and flexible connector boot 54 is reduced by approximately ½ in (1.27 cm) to over 1.25 in (3.17 cm) compared to known connectors having multiple layers of potting material to achieve a seal. This length decrease is achieved through the use of flexible connector boot 54 being partially received within connector 16 which eliminates the need for a second or more potting material seal.

Figure 7:
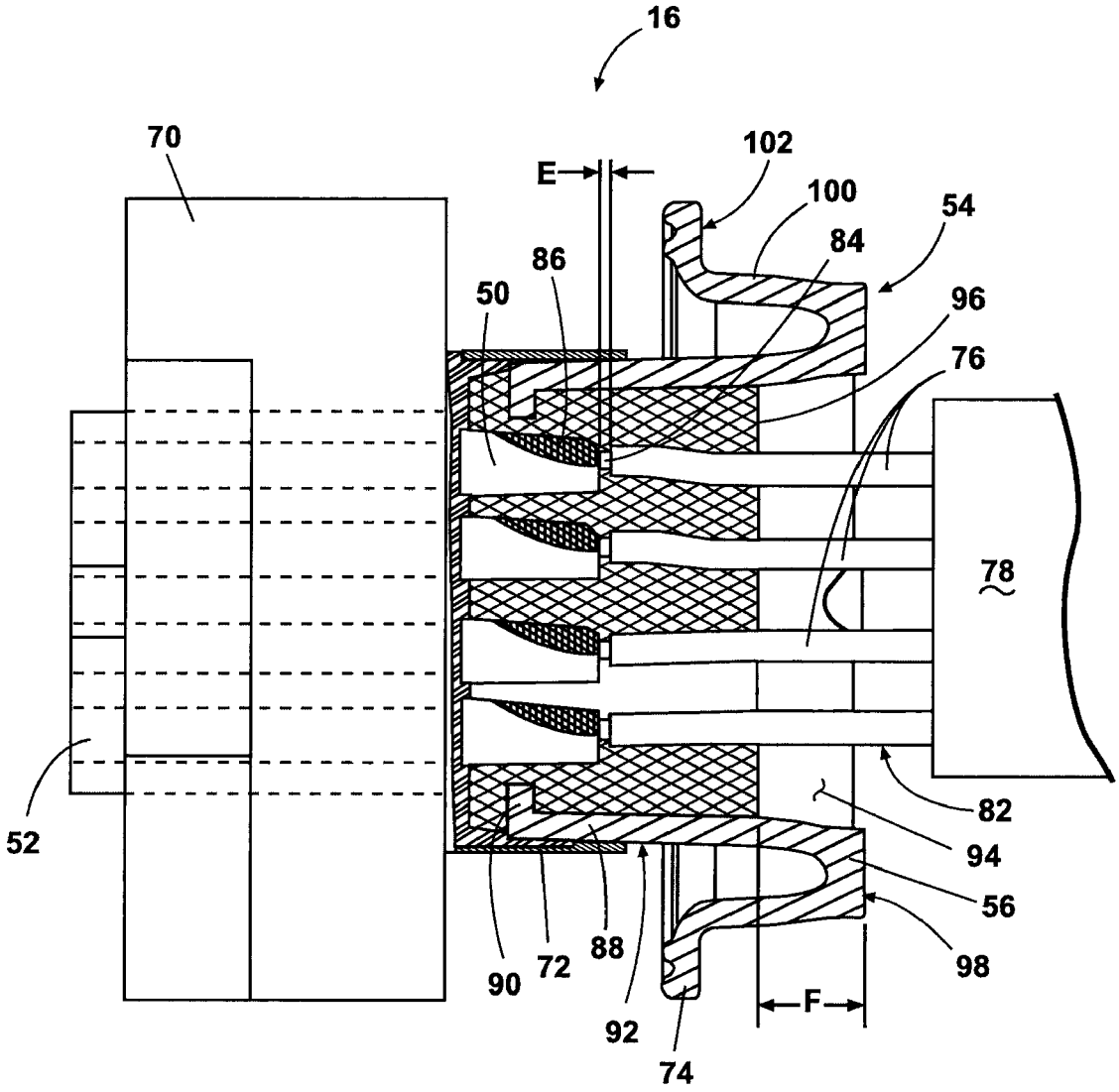
FIG. 7 is a side elevational partial cross sectional view of a portion of the power cable assembly of area 7 of FIG. 6.

Referring to FIG. 7, the electrical connection of conductors 76 to connector 16 is shown in greater detail. Sheathing or insulation 82 is stripped away from each of the conductors 76 to expose conductor wires 84. The conductor wires 84 are inserted into individual ones of the pin receivers 50. A solder joint 86 is created between each of the conductor wires 84 within the pin receivers 50. After the solder joints 86 are created, the flexible connector boot 54 is slid into position as shown. A tubular body 88 of flexible connector boot 54 is frictionally engaged with an inner wall of connector sleeve 72. An inward directed flange 90 of tubular body 88 extends radially inward as shown toward the pin receivers 50. An outer surface 92 of tubular body 88 frictionally engages the inner wall of connector sleeve 72 to temporarily hold tubular body 88 in the position shown such that the conductors 76 are positioned at least partially within an inner cavity 94 defined by tubular body 88. A strip clearance "E" of insulation 82 is controlled such that at least a portion of the insulation 82 of each of the conductors 76 can be covered by a potting compound 96 which is subsequently received within inner cavity 94. A level or depth of potting compound 96 is established using a potting compound fill dimension "F" which is measured from a flat surface 98 defined by the mold kickout members 56. Potting compound fill dimension "F" is predetermined to ensure that at least a portion of the insulation 82 is contacted by the potting compound 96 which grips insulation 82 via adhesion.

Flexible connector boot 54 further includes a flexible sleeve 100 which homogenously connects tubular body 88 to flange 74. A flat surface 102 can be created on flange 74 which is adapted to abut with boot ring 46 as shown and described in reference to FIG. 6. After insertion of potting compound 96, the combination of potting compound 96, inward directed flange 90, and adhesion of potting compound 96 to each of the pin receivers 50 as well as to insulation 82 creates a homogenous seal for these members within inner cavity 94 and helps to prevent withdrawal of tubular body 88 from connector sleeve 72.

Figure 8:
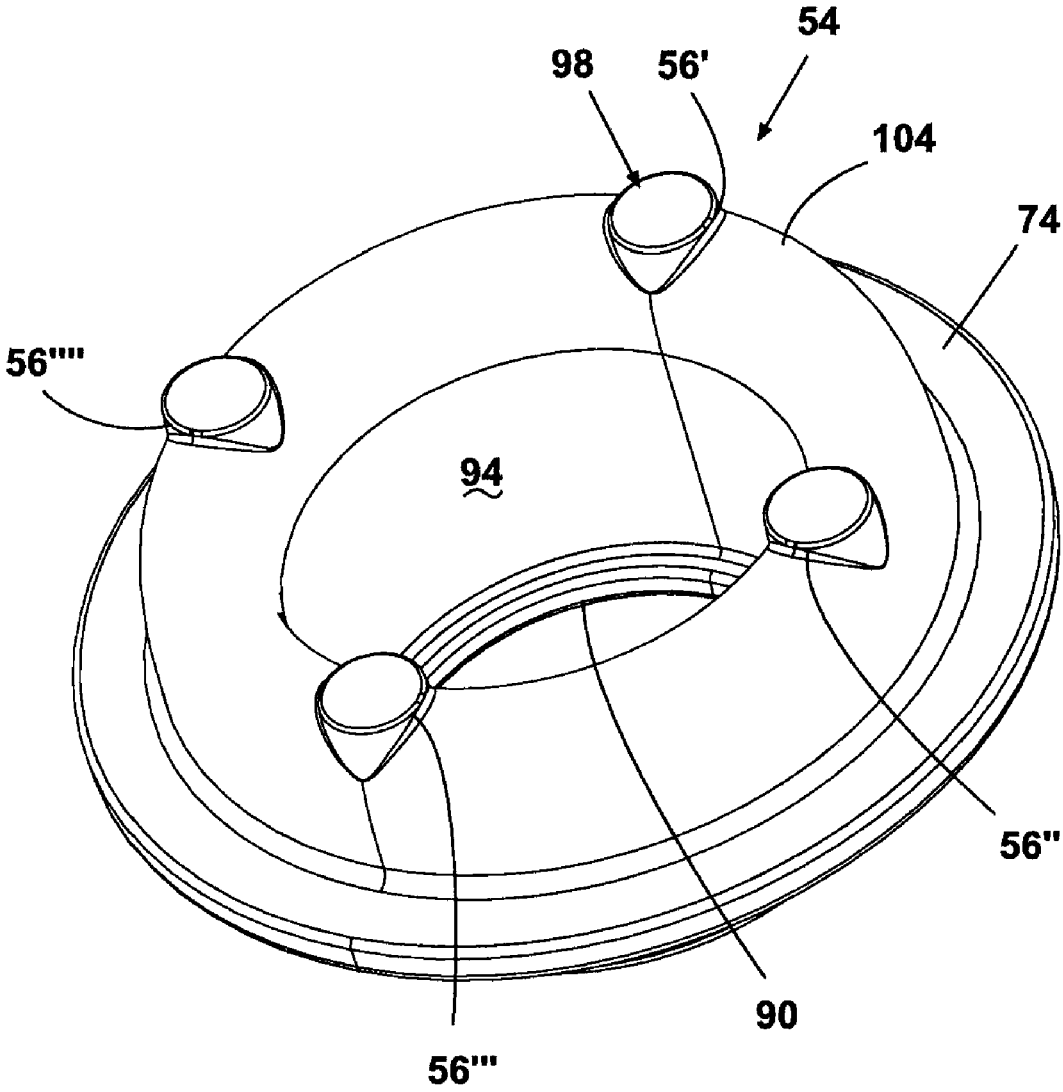
FIG. 8 is a front perspective view of a flexible membrane of the present disclosure.

Referring to FIG. 8, each of the mold kickout members 56 shown herein as mold kickout members 56', 56", 56''', 56'''' extend above and outwardly from a joining wall 104 which elastically and homogenously connects and transitions tubular body 88 to flexible sleeve 100. Inward directed flange 90 extends radially inward with respect to tubular body 88 having an inner wall defining an inner cavity 94.

Figure 10:
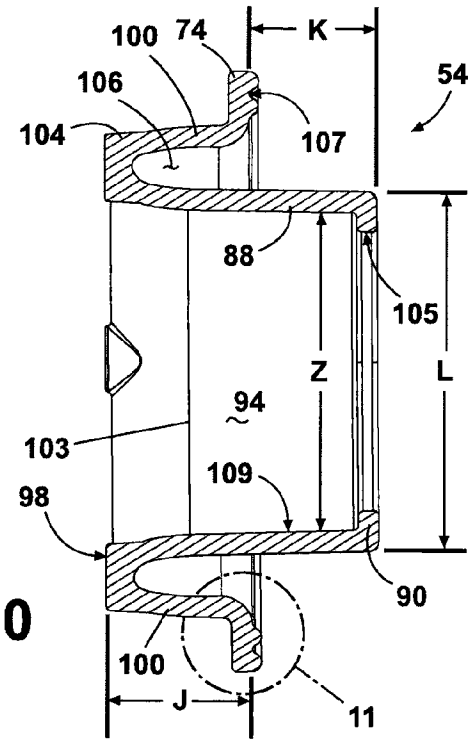
FIG. 10 is a cross sectional side elevational view taken at section 10 of FIG. 9.
Figure 9:
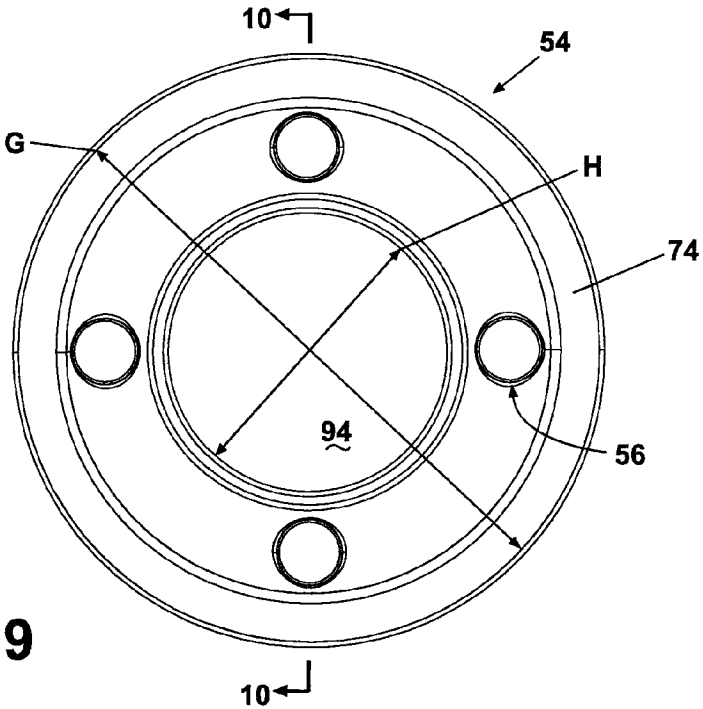
FIG. 9 is a top plan view of the flexible membrane of FIG. 8.

Referring to FIGS. 9, 10, and again to FIGS. 6 and 7, further details of flexible connector boot 54 include a boot flange outer diameter "G" and a boot cavity diameter "H". Boot cavity diameter "H" is defined by a radial inward facing surface 105 of inward directed flange 90. A mold line 103 can be created which provides a visual indication of a desired height of fill for potting compound 96. A clearance gap 106 is created between tubular body 88 and flexible sleeve 100 which permits tubular body 88 to deflect toward or away from flexible sleeve 100 (or vice versa) when flange 74 is fixed by boot ring 46 (not shown in the view). A flange spacing dimension "J" is provided between flat surface 98 of each of the mold kickout members 56 and a lower or opposite facing second surface 107 of flange 74. A flange to inward flange spacing dimension "K" is defined between second surface 107 of flange 74 and surface 105 of inward directed flange 90. An inner cavity diameter "Z" is defined by an inner perimeter wall 109 of tubular body 88 defining inner cavity 94. A tubular body diameter "L" is also dimensionally controlled to be larger than an internal diameter of connector sleeve 72 to ensure that tubular body 88 compresses to frictionally engage the inner wall of connector sleeve 72 as shown and described in reference to FIG. 7.

Figure 11:
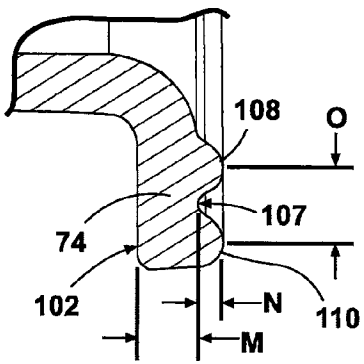
FIG. 11 is an enlarged cross sectional side elevational view taken at area 11 of FIG. 10.

As best seen in reference to FIG. 11, first and second seal rings 108, 110 are created as outwardly directed ridges homogenously extending from second surface 107 of flange 74. First and second seal rings 108, 110 are also oppositely directed from flat surface 102. Flange 74 has a flange thickness "M" defining second surface 107 from which first and second seal rings 108, 110 extend to a seal ring height "N". First and second seal rings 108, 110 are separated by a separation distance "O". According to several embodiments, flange thickness "M" is approximately 0.040 in (0.10 cm), seal ring height "N" is approximately 0.018 in (0.046 cm), and separation distance "O" is approximately 0.05 in (0.127 cm). These dimensions are provided as exemplary dimensions only, and can be varied at the discretion of the manufacturer.

Figure 4:
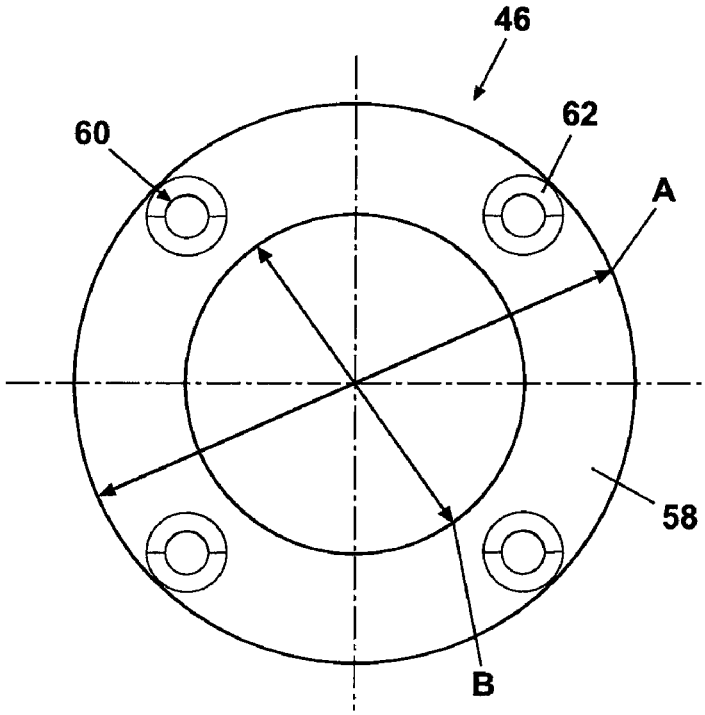
FIG. 4 is a top plan view of a boot ring of the present disclosure.
Figure 5:
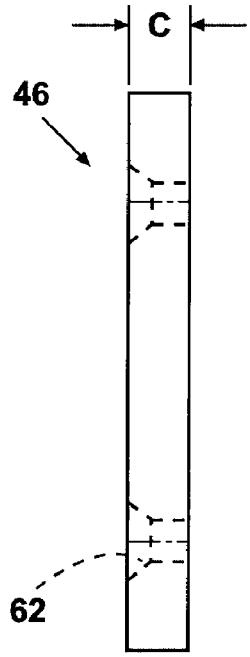
FIG. 5 is a side elevational view of the boot ring of FIG. 4.

With reference to FIG. 12 and again to FIG. 4, connector 16 is assembled to front panel 20 as follows. Flexible connector boot 54 is aligned having joining wall 104 extending through an aperture 111 of boot ring 46. This positions flange 74 in contact with a boot ring surface 112 and allows tubular body 88 to freely extend away from boot ring 46 toward front panel 20. The plurality of fasteners 48 are inserted through boot ring 46 with sufficient clearance between the fasteners 48 and the flange 74 such that no contact is made between fasteners 48 and flange 74. This permits boot ring 46 to contact flexible connector boot 54 at any location with respect to flange 74. The assembly of boot ring 46 and flexible connector boot 54 is coaxially aligned with a longitudinal axis 114 defined through connector housing 70. Fasteners 18 are also shown prior to insertion through connector housing 70 to engage connector housing 70 to front panel 20.

Referring to FIG. 13 and again to FIG. 1, one installation method for connector housing 70 to front panel 20 is as follows. Connector sleeve 72 is slidably received in a clearance aperture 116 created through a wall 118 of front panel 20. Each of the fasteners 18 includes a head 120, an unthreaded shank portion 122, and a threaded shank portion 124. Threaded shank portion 124 of the two fasteners 18 are adapted to be threadably received in each of a threaded aperture 126, 126' created in wall 118. Fasteners 18 are threadably engaged after insertion through connector housing 70 such that threaded shank portion 124 is completely threadably engaged with threaded aperture 126 until a shoulder 128 defining a free end of unthreaded shank portion 122 contacts a surface 130 of wall 118. Threaded shank portion 124 is therefore smaller in diameter than unthreaded shank portion 122 to create shoulder 128. An unthreaded shank portion length "P" is greater than a flange thickness "Q" of a flange 134 of connector housing 70. The greater length of unthreaded shank length "P" allows contact between shoulder 128 and surface 130 before head 120 contacts a flange surface 135 of flange 134.

In addition, a clearance aperture 132 created through flange 134 for each of the fasteners 18 has a diameter which is greater than a corresponding diameter of unthreaded shank portion 122 but less than a diameter of head 120. The greater diameter of clearance aperture 132 allows connector housing 70 and therefore pin receiving member 52 to shift position about the surface 130 of wall 118 when fasteners 18 are fully threadably engaged. This motion of connector housing 70, which is limited by contact between unthreaded shank portion 122 and the inner wall of clearance apertures 132, defines the maximum amount of motion of connector housing 70 and permits alignment of male pins (not shown) of the component 30 described in reference to FIG. 1 with individual ones of the pin receivers 50.

Figure 12:
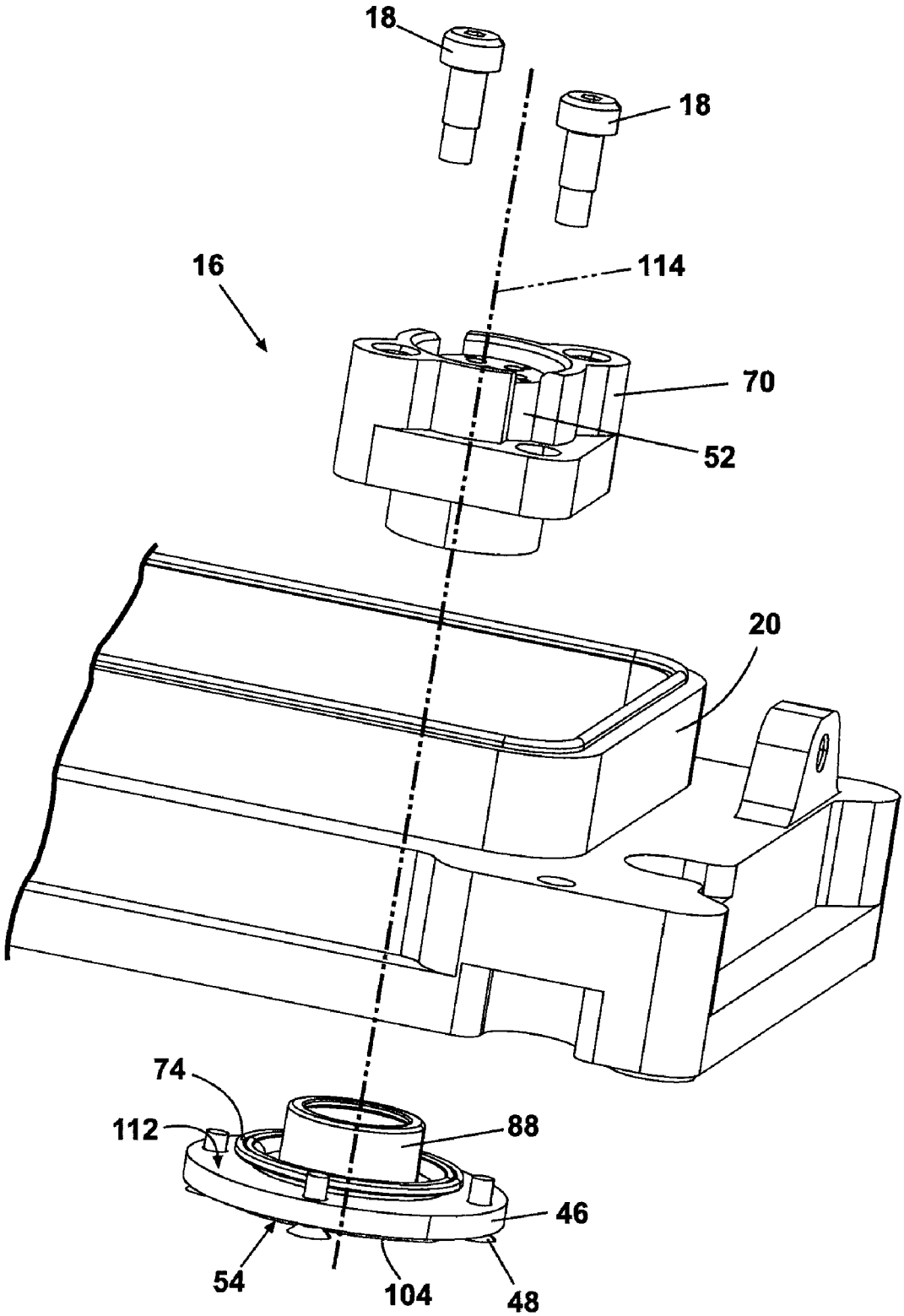
FIG. 12 is a side perspective exploded assembly view of the connector and flexible membrane assembly of the present disclosure.
Figure 13:
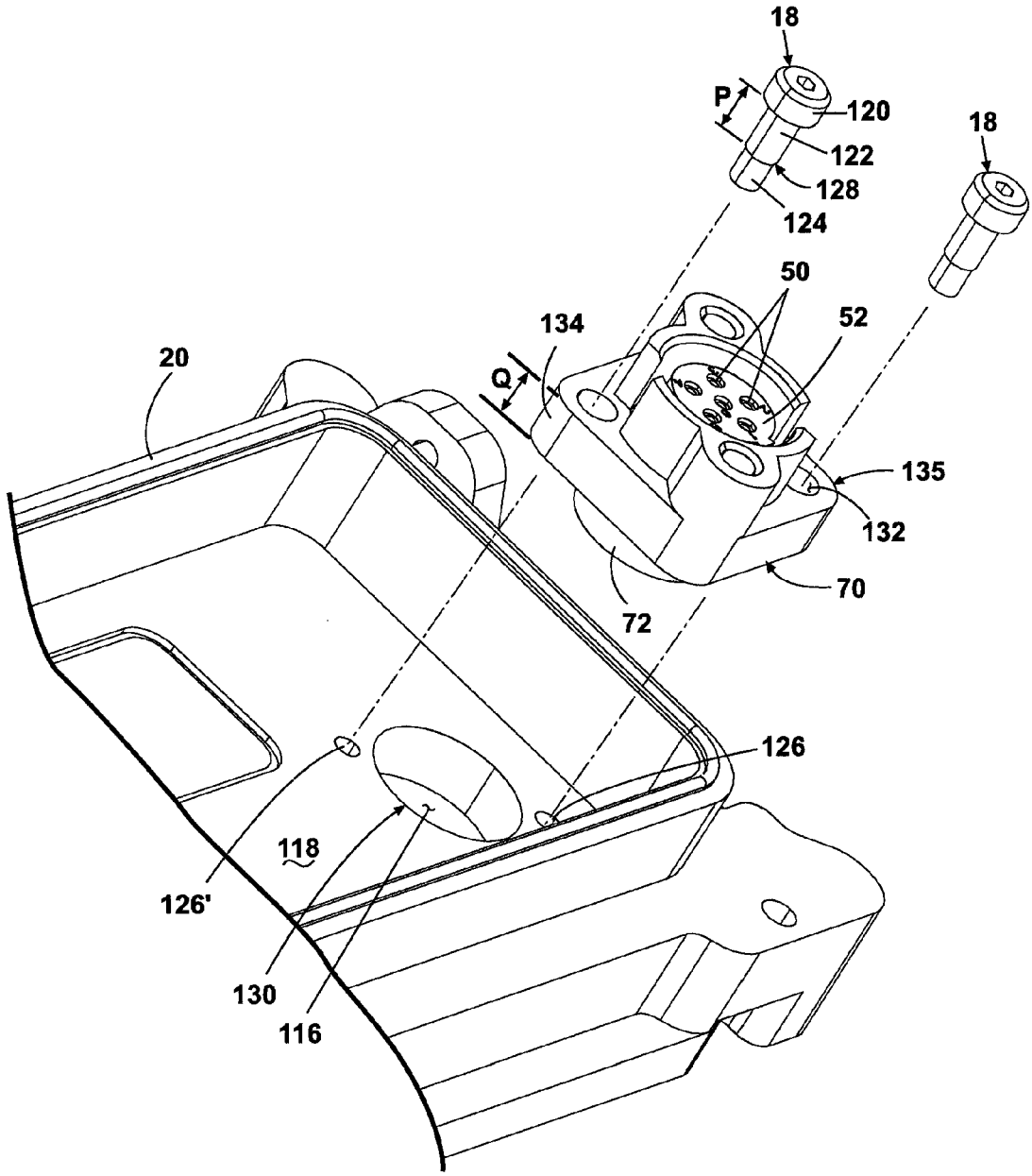
FIG. 13 is a front perspective exploded assembly view of the connector assembly of the present disclosure.
Figure 14:
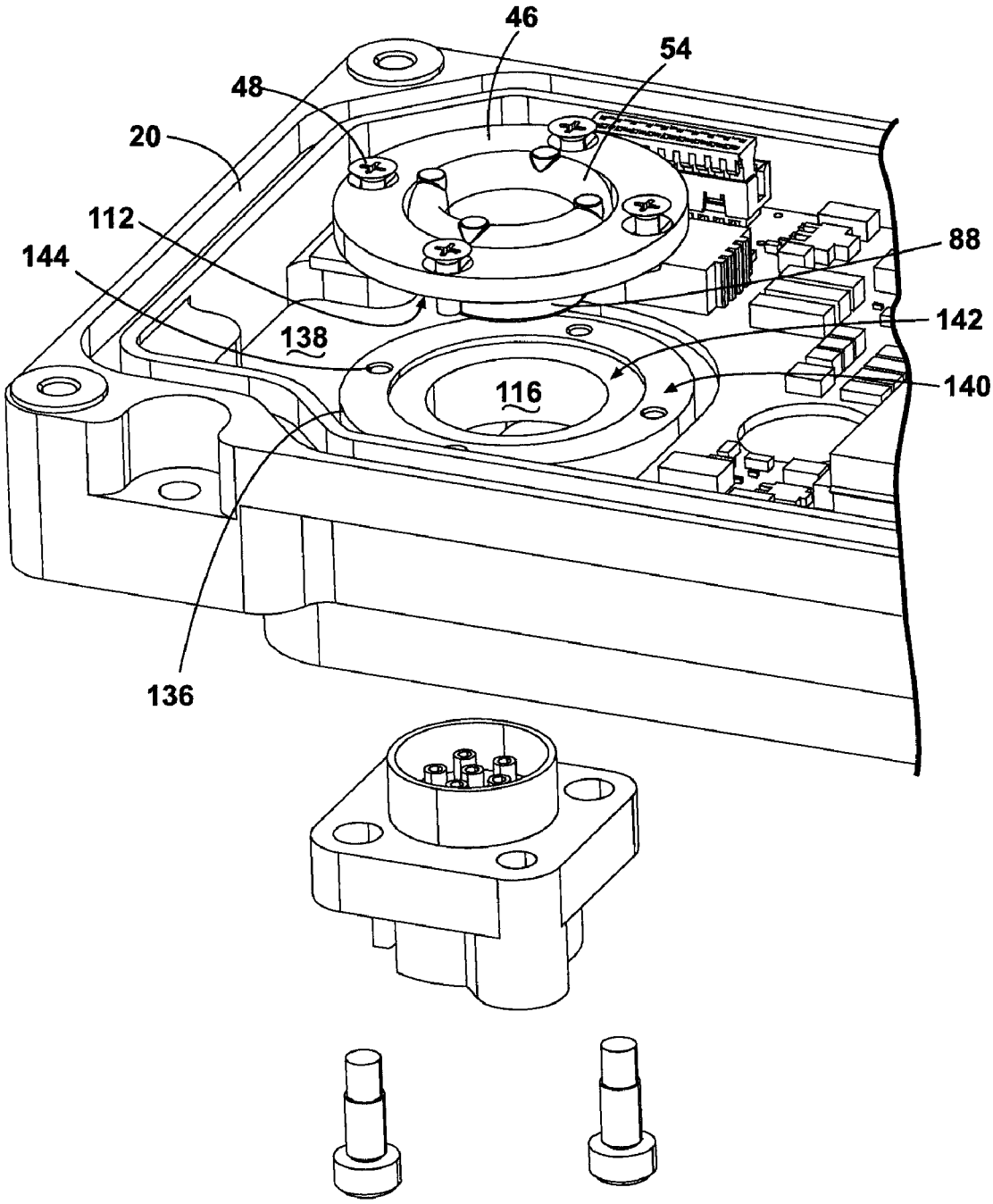
FIG. 14 is a rear perspective exploded assembly view of the flexible membrane and boot ring assembly of the present disclosure.

Referring to FIG. 14 and again to FIGS. 12 and 13, both boot ring 46 and flexible connector boot 54 inserted as shown are aligned for installation with a raised ring 136 which extends above a surface 138 of front panel 20. Surface 138 is the opposite or opposed surface with respect to surface 130 shown and described in reference to FIG. 13. Tubular body 88 of flexible connector boot 54 is received within clearance aperture 116 when boot ring surface 112 contacts a raised ring surface 140 of raised ring 136. To prevent crushing flange 74 (not clearly visible in FIG. 14) of flexible connector boot 54 when boot ring 46 contacts raised ring surface 140, flange 74 is received in a counterbore created within raised ring 136 and contacts a recessed counterbore surface 142. Therefore, when fasteners 48 are threadably received in each of a plurality of threaded apertures 145 created through raised ring surface 140 to move boot ring surface 112 into contact with raised ring surface 140, the first and second seal rings 108, 110 of flange 74 are fully engaged and compressed by contact with recessed counterbore surface 142.

Referring again to FIGS. 6, 7, and 13, according to another embodiment, the entire assembly of components shown in FIG. 6, including connector 16 and wiring assembly 64 can be installed as a sub-assembly by first rolling flange 74 and flexible sleeve 100 to the right as viewed in FIG. 7 to reduce the outer diameter of flexible connector boot 54 sufficient to fit within clearance aperture 116 of front panel 20. Installation of the sub-assembly is then completed by inserting clip connector 68, then wiring assembly 64, the rolled flange 74 and flexible sleeve 100, and then connector sleeve 72 through clearance aperture 116 from the wall 118 side of front panel 20. Once this insertion is completed, flange 74 and flexible sleeve 100 are returned to the pre-rolled condition shown in FIG. 6 and boot ring 46 is then installed. This assembly option allows the wiring connections of conductors 76 and 76' to be completed first when these connections are easily accessible.

A flexible connector boot 54 for a floating sealed interface of the present disclosure offers several advantages. By eliminating a layer of potting material as well as a plate required to retain the potting material and replacing these with a flexible connector boot, a flexible seal is provided which allows for deflection of a pin receiving member of a connector in both X and Y coordinate axes in addition to providing a homogenous seal. The connector boot of the present disclosure reduces the number of construction and installation steps required for electrical connectors. Also, by providing a positive engagement boot ring which engages a flange of the connector boot a positive seal using raised O-ring type seals is created which improves upon the previously used potting material only seals provided with previous connector assemblies.

What is claimed is:

1. A flexible boot for a sealed interface, comprising:
- a tubular body of an elastically flexible material;
- a flexible sleeve positioned outward of the tubular body;
- a joining wall homogenously joining the tubular body to the flexible sleeve; and
- a first flange extending radially outward from and homogeneously connected to a free end of the flexible sleeve defining a circular ring oriented substantially transverse to and encircling the flexible sleeve, the flange including:
  - a flat engagement surface; and
  - a second surface opposed to the flat engagement surface having at least one raised seal ring extending therefrom.

2. The flexible boot of claim 1, further comprising a second flange extending inwardly from a free end of the tubular body and oppositely with respect to the radially outward directed first flange, and located at an opposite end of the tubular body with respect to the joining wall.

3. The flexible boot of claim 2, wherein the second flange extends substantially transverse to and is homogenously connected to the tubular body.

4. The flexible boot of claim 2, further comprising a radial inward facing surface of the second flange defining a cavity diameter smaller than an inner cavity diameter defined by the tubular body.

5. The flexible boot of claim 1, further comprising at least one kickout member homogenously extending from the joining wall and having a substantially flat face.

6. A flexible boot for a sealed interface, comprising:
- a tubular body of an elastically flexible material;
- a flexible sleeve positioned outward of the tubular body;
- a joining wall homogenously joining the tubular body to the flexible sleeve; and
- a flange extending from a free end of the flexible sleeve defining a circular ring oriented substantially transverse to and encircling the flexible sleeve, the flange including:
  - a flat engagement surface;
  - a second surface opposed to the flat engagement surface having at least one raised seal ring extending therefrom; and
- a clearance gap created between the tubular body and the flexible sleeve operating to allow the tubular body to axially deflect with respect to the flexible sleeve when the flange is rigidly fixed.

7. The flexible boot of claim 6, wherein the flange is homogenously connected to the flexible sleeve, and wherein the second surface having at least one raised seal ring is oriented away from the joining wall to permit the at least one raised seal ring to create a fluid seal about the clearance gap when the flange is rigidly fixed.

8. A flexible boot for a sealed electrical connector interface, comprising:
- a tubular body of an elastically flexible material;
- a flexible sleeve positioned outward of the tubular body;
- a joining wall homogenously connecting the flexible sleeve to the tubular body;
- a first flange homogenously extending from a free end of the flexible sleeve defining a circular ring oriented substantially transverse to and encircling the flexible sleeve;
- a second flange of the elastically flexible material extending transversely inward from a free end of the tubular body defining a diameter smaller than an inner diameter of the tubular body.

9. The flexible boot of claim 8, wherein the first flange includes a flat engagement surface.

10. The flexible boot of claim 9, wherein the first flange further includes a surface opposed to the flat engagement surface having first and second raised seal rings homogenously connected to and extending therefrom.

11. The flexible boot of claim 8, further comprising a mold line created on an inner wall of the tubular body defining a visual fill location for a potting material.

12. An electrical connector having a flexible boot operable to create a sealed interface, comprising:
- a connector body having a plurality of pin receivers positioned within a tubular sleeve;
- a flexible boot of an elastically flexible material adapted to be received in the connector body, the flexible boot including:

a tubular body, the tubular body having a body diameter dimensionally controlled to provide an interference fit when received in the tubular sleeve of the connector body;

a flexible sleeve positioned outward of the tubular body such that a clearance gap is created between the tubular body and the flexible sleeve;

a joining wall homogenously joining the tubular body to the flexible sleeve;

a first flange homogenously extending from a free end of the flexible sleeve defining a circular ring oriented substantially transverse to and encircling the flexible sleeve; and a second flange extending inwardly from a free end of the tubular body and located at an opposite end of the tubular body with respect to the joining wall.

13. The electrical connector of claim 12, wherein the first flange includes a flat engagement surface.

14. The electrical connector of claim 13, further comprising a boot ring having an inner diameter adapted to allow the boot ring to be slidably received around the flexible sleeve of the flexible boot and a flat surface adapted to engage with the flat engagement surface of the first flange.

15. The electrical connector of claim 13, wherein the first flange includes a surface opposed to the engagement surface having at least one raised seal ring homogenously connected to and extending therefrom.

16. The electrical connector of claim 15, wherein the second flange includes a radial inward facing surface defining a cavity diameter smaller than an inner cavity diameter defined by the tubular body, the cavity diameter sized to freely receive the plurality of pin receivers when the tubular body is received in the tubular sleeve of the connector body.

17. The electrical connector of claim 12, wherein the tubular body includes a mold line providing a visual indication of a desired fill height for a potting compound received in the tubular body after the tubular body is received in the tubular sleeve of the connector body, the potting compound adapted to contact the plurality of pin receivers and the tubular body.

18. The electrical connector of claim 12, further including a plurality of conductors individually electrically fixed to individual ones of the plurality of pin receivers, the plurality of conductors partially received in the potting compound.

19. An assembly for flexibly mounting an electrical connector, comprising:

a connector body having a tubular sleeve, the connector body adapted to be slidably received in an aperture of a panel;

a flexible boot adapted to be received in the connector body, the flexible boot including:

a tubular body of an elastically flexible material, the tubular body having a body diameter dimensionally controlled to provide an interference fit when received in the tubular sleeve of the connector body;

a flexible sleeve positioned outward of and homogenously connected to the tubular body; and a flange homogenously connected to and defining a free end of the flexible sleeve, the flange shaped as a circular ring oriented substantially transverse to and encircling the flexible sleeve; and a boot ring adapted to fix the flange with respect to the panel, the connector body thereafter elastically displaceable with respect to the panel when the tubular body deflects with respect to the flexible sleeve and the flange.

20. The assembly of claim 19, wherein the flexible boot further includes a joining wall homogenously joining the tubular body to the flexible sleeve.

21. The assembly of claim 19, wherein the connector body includes a plurality of pin receivers, the pin receivers positionable within the tubular sleeve.

22. The assembly of claim 19, wherein the tubular body includes a mold line providing a visual indication of a desired fill height for a potting compound received in the tubular body after the tubular body is received in the tubular sleeve of the connector body.

23. The assembly of claim 19, further comprising:

a plurality of pin receivers disposed within the connector body;

a plurality of conductors individually electrically fixed to individual ones of the plurality of pin receivers; and a potting compound disposed within the tubular body of the flexible boot adapted to adhere to the plurality of conductors, the plurality of pin receivers, and the tubular body.

24. The assembly of claim 19, wherein the boot ring includes an inner diameter adapted to allow the boot ring to be slidably received around the flexible sleeve of the flexible boot, and a flat surface adapted to engage with the flat engagement surface of the flange when the boot ring is fastenably connected to the panel.

25. A method for flexibly connecting and sealing an electrical connector to a panel, comprising:

extending a tubular sleeve from a connector body;

coupling a flexible boot having a tubular body of elastically flexible material in the tubular sleeve;

creating a boot flexible sleeve outward of the tubular body;

homogenously joining the tubular body to the flexible sleeve using a boot joining wall;

homogenously extending a flange from a free end of the flexible sleeve defining a circular ring oriented transverse to and encircling the flexible sleeve;

fixing the flange to the panel using a boot ring to permit the connector body to elastically displace with respect to the panel when the tubular body deflects with respect to the flexible sleeve and the flange.

26. The method of claim 25, further comprising positioning a plurality of pin receivers within the tubular sleeve of the connector body.

27. The method of claim 26, further comprising:

individually electrically fixing a plurality of conductors to individual ones of the plurality of pin receivers; and disposing a potting compound within the tubular body of the flexible boot adapted to adhere to the plurality of conductors, the plurality of pin receivers, and the tubular body.

28. The method of claim 25, further comprising dimensionally controlling a body diameter of the tubular body to provide an interference fit when the tubular body is received in the tubular sleeve.

* * * * *